US009694505B2

(12) United States Patent
Clifford

(10) Patent No.: US 9,694,505 B2
(45) Date of Patent: Jul. 4, 2017

(54) ANTI-LIGATURE ACTUATORS

(71) Applicant: Schlage Lock Company LLC, Indianapolis, IN (US)

(72) Inventor: Jason Curtis Clifford, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 84 days.

(21) Appl. No.: 14/624,871

(22) Filed: Feb. 18, 2015

(65) Prior Publication Data

US 2016/0237719 A1 Aug. 18, 2016

(51) Int. Cl.

| | |
|---|---|
| ***E05C 1/04*** | (2006.01) |
| ***B26D 1/02*** | (2006.01) |
| ***E05B 3/00*** | (2006.01) |
| *E05B 1/00* | (2006.01) |

(52) U.S. Cl.
CPC ..... *B26D 1/025* (2013.01); *E05B 3/00* (2013.01); *E05B 1/0007* (2013.01)

(58) Field of Classification Search
CPC ..... Y10S 292/65; E05B 63/08; E05B 63/10; E05B 65/00; E05B 65/0017; E05B 65/0032; E05B 1/0007; Y10T 70/5226
See application file for complete search history.

(56) References Cited

U.S. PATENT DOCUMENTS

| | | | | |
|---|---|---|---|---|
| 5,038,475 | A * | 8/1991 | Wolff | A61J 7/0007 225/103 |
| 5,118,021 | A * | 6/1992 | Fiocchi | A61J 7/0007 225/103 |
| 5,797,286 | A * | 8/1998 | Armstrong | E05B 13/10 70/190 |
| 6,557,945 | B1 * | 5/2003 | Eric | A61J 7/0007 30/124 |
| 7,373,694 | B1 * | 5/2008 | Kopp | E05B 1/0015 16/412 |
| 7,631,655 | B1 * | 12/2009 | Kopp | E03C 1/04 137/15.18 |
| 8,430,436 | B2 | 4/2013 | Shilts | |
| 8,534,723 | B2 | 9/2013 | Berger | |
| D690,577 | S | 10/2013 | Eller et al. | |
| 8,646,151 | B2 * | 2/2014 | Kopp | E04F 11/1802 16/110.1 |
| 8,720,960 | B2 | 5/2014 | Nadgouda et al. | |
| 8,740,266 | B2 | 6/2014 | Keller | |
| 8,777,282 | B1 | 7/2014 | Shilts | |
| 9,003,577 | B2 * | 4/2015 | Kopp | E03C 1/1225 137/315.15 |
| 9,033,375 | B1 * | 5/2015 | Moon | E05B 1/003 292/140 |
| 2010/0072762 | A1 | 3/2010 | Marks | |
| 2011/0315245 | A1 | 12/2011 | Neagoe | |
| 2012/0085432 | A1 | 4/2012 | Keller | |

(Continued)

*Primary Examiner* — Daniel J Troy
*Assistant Examiner* — Andres F Gallego
(74) *Attorney, Agent, or Firm* — Schlage Lock Company LLC

(57) ABSTRACT

An actuator assembly including a mounting device, a manual actuator rotatably mounted on the mounting device, and a cutting mechanism. The cutting mechanism is disposed in a gap that is formed between the manual actuator and the mounting device. The cutting mechanism is structured to cut a ligature inserted into the gap.

24 Claims, 8 Drawing Sheets

(56) References Cited

U.S. PATENT DOCUMENTS

| | | | | |
|---|---|---|---|---|
| 2012/0199228 | A1 | 8/2012 | Keller | |
| 2013/0270844 | A1 | 10/2013 | Berger et al. | |
| 2014/0239651 | A1 | 8/2014 | Shilts | |
| 2014/0265375 | A1 | 9/2014 | Keller | |
| 2014/0311194 | A1 | 10/2014 | Berger et al. | |
| 2015/0130197 | A1* | 5/2015 | Eller ..... | E05B 1/00<br>292/336.3 |

* cited by examiner

ANTI-LIGATURE ACTUATORS

TECHNICAL FIELD

The present disclosure generally relates to anti-ligature actuators, and more particularly but not exclusively relates to locksets including manual actuators having ligature-defeating features.

BACKGROUND

Anti-ligature manual actuators are occasionally installed in institutions which house residents that are at an increased risk or susceptibility of attempting suicide such as, for example, prisons and mental health facilities. Conventional actuators of this type have geometries which discourage the actuator from being used as an anchor for a ligature. Some actuators of this type have certain limitations such as, for example, the inability to defeat thin ligatures. Therefore, a need remains for further improvements in this technological field.

SUMMARY

An exemplary actuator assembly includes a mounting device, a manual actuator rotatably mounted on the mounting device, and a cutting mechanism. The cutting mechanism is disposed in a gap between the manual actuator and the mounting device, and is configured to cut a ligature which has been inserted into the gap. Further embodiments, forms, features, and aspects of the present application shall become apparent from the description and figures provided herewith.

DETAILED DESCRIPTION OF ILLUSTRATIVE EMBODIMENTS

Figure 1:
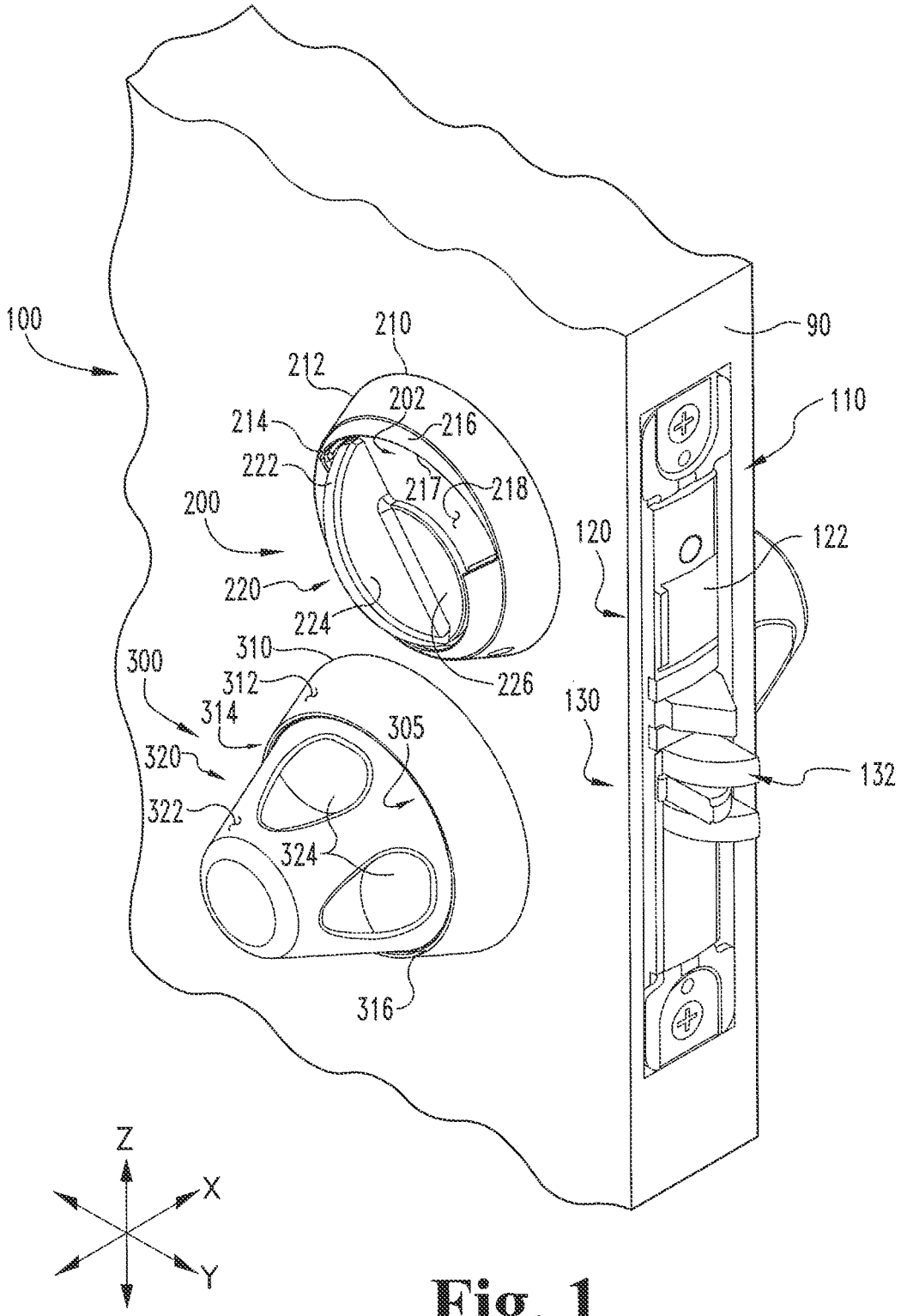
FIG. 1 is a perspective view of a lockset according to one embodiment, as mounted to a door.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal", "lateral" and "transverse" are used to denote motion or spacing along three mutually perpendicular axes. In the coordinate plane illustrated in FIG. 1, the X-axis defines longitudinal directions (including a proximal direction and a distal direction), the Y-axis defines lateral directions, and the Z-axis defines transverse directions. These terms are used for ease of convenience and description, and are without regard to the particular orientation of the system with respect to the environment. For example, descriptions that reference a longitudinal direction may be equally applicable to a vertical direction, a horizontal direction, or an off-axis orientation with respect to the environment. Additionally, motion or spacing along one direction need not preclude motion or spacing along another of the directions. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

Figure 2:
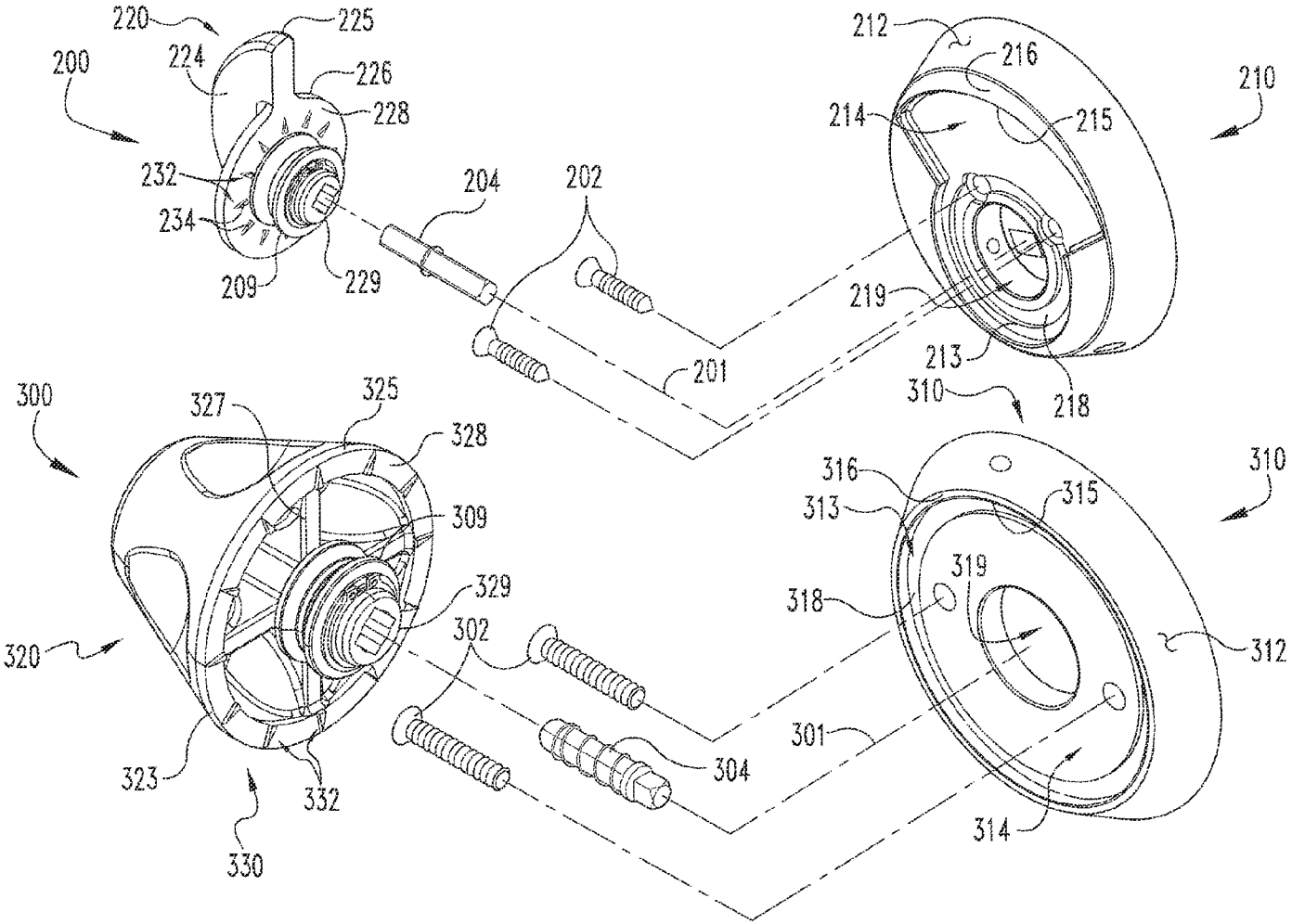
FIG. 2 is an exploded assembly view of a portion of the lockset illustrated in FIG. 1, including a knob assembly according to one embodiment.

With reference to FIGS. 1 and 2, a lockset 100 according to one embodiment generally includes a mortise assembly 110 which is installed in a mortise cutout of a door 90 and includes a deadbolt mechanism 120 and a latchbolt mechanism 130. The deadbolt mechanism 120 includes a deadbolt 122 operable in an extended or locking position and a retracted or unlocking position. The latchbolt mechanism 130 includes a latchbolt 132 operable in an extended or latching position and a retracted or unlatching position. The lockset 100 further includes a thumbturn assembly 200 operably connected with the deadbolt mechanism 120, and a knob assembly 300 operably connected with the latchbolt mechanism 130. As described in further detail below, each of the thumbturn assembly 200 and the knob assembly 300 includes a rotatable manual actuator.

Additionally, each of the deadbolt mechanism 120 and the latchbolt mechanism 130 may be engaged with the manual actuator of the corresponding one of the thumbturn assembly 200 and the knob assembly 300 such that rotation of the manual actuator causes the corresponding one of the deadbolt 122 and the latchbolt 132 to extend or retract. The mortise assembly 110 (i.e., the deadbolt mechanism 120 and the latchbolt mechanism 130) may be of any type known in the art and need not be further described herein.

In one embodiment, the thumbturn assembly 200 includes a housing 210 securely mounted to the door 90, and a manual actuator in the form of a thumbturn 220 which is rotatably mounted on the housing 210. As described in further detail below, a gap 208 is formed between the housing 210 and the thumbturn 220, and the thumbturn assembly 200 also includes a cutting mechanism 230 positioned in the gap 208.

The housing 210 includes an outer circumferential surface 212 and a recess 214 defined in part by a ridge 216. The circumferential surface 212 tapers radially inward from a distal side of the housing 210 toward a proximal side of the housing 210. The housing 210 also includes an arcuate channel 213, which in the illustrated embodiment is provided as an annular channel 213 formed within the recess 214. The channel 213 is formed on the proximal side of the housing 210 and defines a proximal housing surface 218. The illustrated thumbturn 220 includes a manually graspable portion 224 defining a proximal surface 222, and a disc portion 226 seated in a circular portion of the recess 214.

The housing 210 may be secured to the door 90 via fasteners such as screws 202, and the disc portion 226 may cover and prevent external access to the screws 202. The thumbturn 220 also includes a distally-extending stem 229, and the housing 210 includes an opening 219 sized and configured to receive the stem 229. With the thumbturn 220 mounted on the housing 210, the stem 229 extends into the opening 219, and defines an axis 201 about which the thumbturn 220 pivots or rotates. Additionally, the thumbturn 220 is operably coupled to the deadbolt mechanism 120 in a known manner. For example, a spindle 204 may rotationally couple the stem 229 to a retractor of the deadbolt mechanism 120. The thumbturn assembly 200 may further include a bearing or a bushing 209 mounted on the stem 229 and received in the opening 219 so as to provide structural support and/or to reduce friction.

When assembled, a radially outer surface 225 of the manually graspable portion 224 is positioned adjacent the radially inner surface 215 of the ridge 216. The ridge 216 thereby covers the radially outer surface 225 in the radial direction, and a narrow seam 205 is formed between the surfaces 215, 225. Additionally, the disc portion 226 covers the annular channel 213 such that a gap 208 is formed between the thumbturn distal surface 228 and the housing proximal surface 218. As described in further detail below, the cutting mechanism 230 is positioned in the gap 208 between the housing 210 and the thumbturn 220.

As should be appreciated, the thumbturn assembly 200 is configured to deter the assembly 200 from being used as an anchor for a ligature. For example, if a person attempts to wrap a ligature such as, for example, a rope around the housing 210, the angled circumferential surface 212 will urge the ligature in the proximal direction (i.e., toward the thumbturn 220). The curved proximal surface 222 of the manually graspable portion 224 is also configured to urge the ligature in the proximal direction, thereby causing the ligature to fall off of the thumbturn 220. Additionally, with the ridge 216 covering the radially outer surface of the manually graspable portion 224, the angled circumferential surface 212 and the ridge 216 urge the ligature into contact with the curved proximal surface 222, thereby discouraging the ligature from entering the seam 205.

Figure 3:
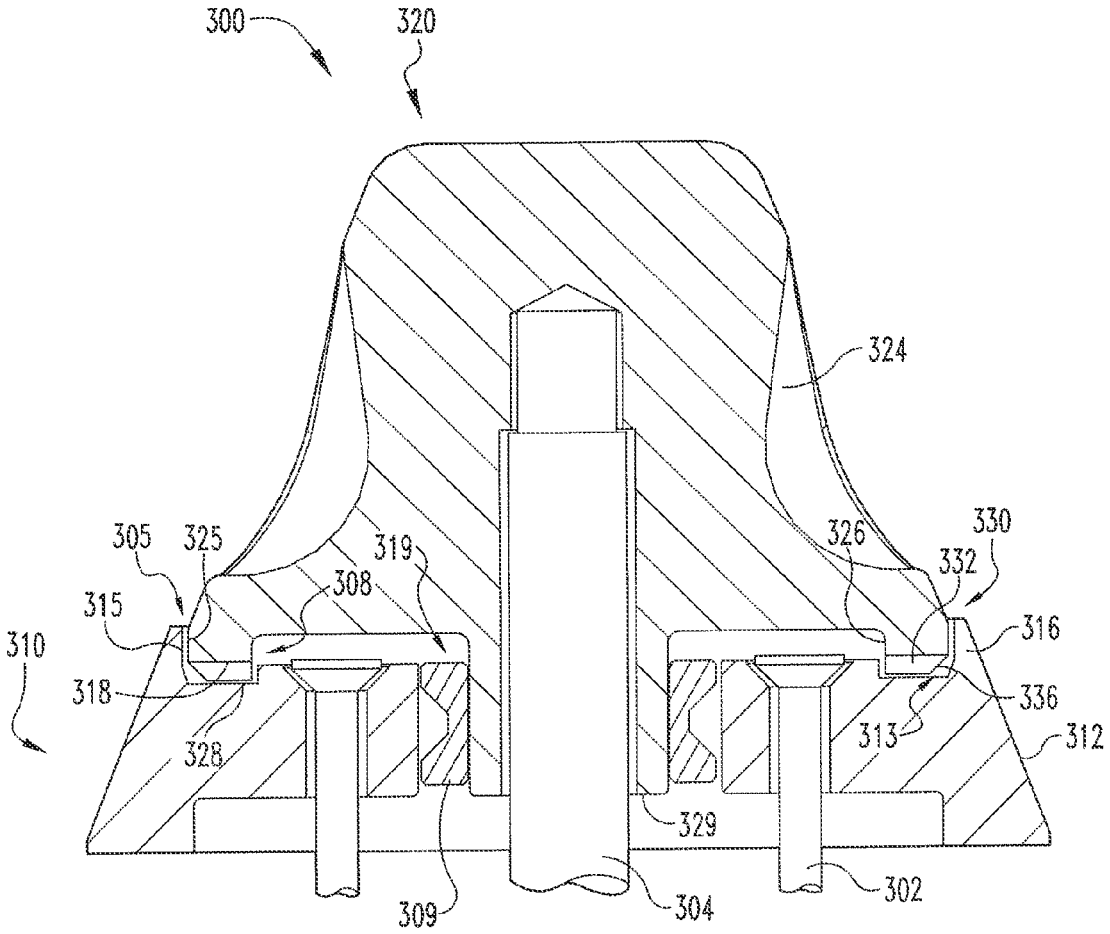
FIG. 3 is a cross-sectional view of the knob assembly illustrated in FIG. 2.

With additional reference to FIG. 3, the knob assembly 300 includes a housing 310 securely mounted to the door 90, and a manual actuator in the form of a knob 320 which is rotatably mounted on the housing 310. As described in further detail below, a gap 308 is formed between the housing 310 and the knob 320, and the knob assembly 300 further includes a cutting mechanism 330 positioned in the gap 308.

The illustrated housing 310 includes an outer circumferential surface 312 and a circular recess 314 defined in part by a ridge 316. The circumferential surface 312 tapers radially inward from a distal side of the housing 310 toward a proximal side of the housing 314. The housing 310 also includes an annular channel 313 which is formed within the recess 314. The channel 313 is formed on the proximal side of the housing 310 and defines a proximal housing surface 318. The housing 310 may be secured to the door 90 via fasteners such as, for example, screws 302, and the knob 320 may cover and prevent external access to the screws 302.

The illustrated knob 320 defines an outer surface 322 and may include one or more indentations 324 configured to facilitate grasping of the knob 320. The distal end of the knob 320 includes an annular portion 323 which is seated in the annular channel 313 and defines a distal knob surface 328. The illustrated knob 320 also includes a distally-extending stem 329 configured to transmit rotation of the knob 320 to the latchbolt mechanism 130, and the housing 310 includes an opening 319 sized and configured to receive the stem 329. The knob 320 may be partially hollow and may include one or more support posts 327 extending radially outward from the stem 329 toward the annular portion 326.

With the knob 320 mounted on the housing 310, the stem 329 extends into the opening 319, thereby defining an axis 301 about which the knob 320 pivots or rotates. Additionally, the knob 220 is operably coupled to the latchbolt mechanism 130 in a known manner. For example, a spindle 304 may rotationally couple the stem 329 to a retractor of the latchbolt mechanism 130. As illustrated in FIG. 3, the knob assembly 300 may further include a bearing or bushing 309 rotatably supporting the stem 329 within the opening 319.

When assembled, a radially outer surface 325 of the distal end of the knob 320 is positioned proximate the radially inner surface 315 of the ridge 316. The ridge 316 covers and circumferentially surrounds the radially outer surface 325, thereby forming a narrow seam 305 between the surfaces 315, 325. Additionally, the annular portion 323 of the knob 320 is received in the annular channel 313 of the housing 310. As such, the knob distal surface 328 faces the housing proximal surface 318, thereby forming a narrow annular gap 308 therebetween. The gap 308 is in communication with the seam 305 such that a ligature may pass through the seam 305 and enter the gap 308 as the ligature travels toward the stem 329.

The knob assembly 300 is also configured to deter the assembly 300 from being used as an anchor for a ligature, and the included features may function in a substantially similar manner as described above with regard to the thumbturn assembly 200. In the illustrated form, the circumferential surfaces 212, 312 are angled or tapered such that the housings 210, 310 are substantially frustoconical. It is also contemplated that one or both of the surfaces 212, 312 may be partially or entirely curvilinear. Additionally, while the surfaces 222, 322 of the illustrated manual actuators 220, 320 include curvilinear portions, in other embodiments, one or both of the surfaces 222, 322 may be partially or entirely rectilinear.

While the features of the exposed surfaces of the assemblies 200, 300 deter the assemblies 200, 300 from being used as an anchor for a thick ligature such as a rope, a person may nonetheless attempt to use one of the assemblies 200, 300 as an anchor for a thin ligature such as a thread or dental floss. For example, a person may be able to insert a thin ligature through the seam 305 of the knob assembly 300 in an attempt to use the knob 320 and/or the stem 329 as an anchor. The cutting mechanism 330, however, is configured to defeat such an attempt. As noted above, the cutting mechanism 330 of the knob assembly 300 is positioned in the gap 308 between the housing 310 and the knob 320. More specifically, the cutting mechanism 330 includes a plurality of cutting elements 332 which extend distally into the gap 308 from angularly spaced locations about the annular portion 323.

Figure 4:
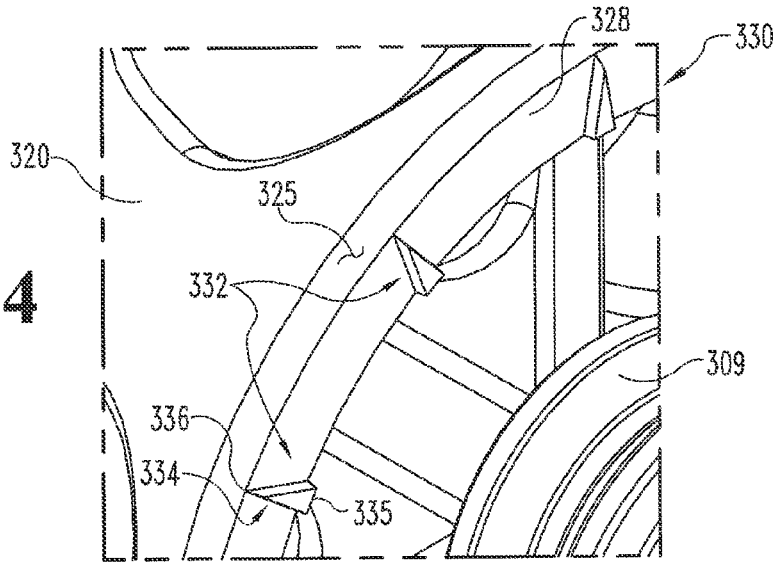
FIG. 4 is an enlarged perspective view of a portion of the knob assembly illustrated in FIG. 2.

With additional reference to FIG. 4, each of the illustrated cutting elements 332 defines a wedge which expands from a radially outer tip 334 toward a radially inner base 335.

Each of the cutting elements 332 also includes a sharpened edge 336 which extends distally from the tip 334 and into the gap 308. If a person is able to pass a thin ligature through the seam 305, the ligature will be forced into contact with the sharpened edges 336 as the person attempts to wrap the ligature around the stem 329. When this occurs, one or more of the sharpened edges 336 will sever the ligature, thereby defeating the attempt to use the knob assembly 300 as an anchor. In the illustrated form, the edge 336 forms an oblique angle with respect to the knob distal surface 328. In other words, the edge 336 extends both radially and longitudinally. However, in other embodiments, the edges 336 may extend in only a longitudinal direction such that the edges 336 are instead arranged perpendicular to the distal surface 328 of the knob 320.

In some embodiments, the thumbturn assembly cutting mechanism 230 is substantially similar to the knob assembly cutting mechanism 330. Unless indicated otherwise, similar reference characters are used to indicate similar elements and features. In the interest of conciseness, the following descriptions focus primarily on features that are different from those described above with regard to the knob assembly cutting mechanism 330.

In the thumbturn assembly 200, the cutting mechanism 230 includes a plurality of cutting elements 232, at least some of which may be formed on the distal side of the disc portion 226. The cutting elements 232 are angularly spaced in an arcuate pattern about the rotational axis 201 of the thumbturn 220 and extend into the channel 218. In the illustrated embodiment, the arcuate pattern is a circular pattern, and the channel 218 is an annular channel, each of which is centered about the rotational axis 201. In other embodiments, the arcs defining the pattern and the channel 218 need not form complete circles. For example, an arc defining the channel 218 may have a central angle sufficient to allow the cutting elements 232 to travel through the channel 218 without interference as a user rotates or pivots the thumbturn 220 to actuate the deadbolt mechanism 120.

As is evident in FIG. 1, the cutting mechanisms 230, 330 are not manually accessible when the lockset 100 is assembled. For example, the knob 320 axially covers the cutting mechanism 330 such that the cutting elements 332 are only accessible through the seam 305. Similarly, the disc portion 226 of the thumbturn 220 axially covers the cutting mechanism 230 such that the cutting elements 232 are not manually accessible. As a result, the cutting elements 232, 332 are not exposed, thereby preventing potential injury to users.

While the illustrated lockset 100 includes a mortise assembly 110, it is also contemplated that the thumbturn assembly 200 and/or the knob assembly 300 may be utilized in combination with other forms and configurations of lockset. For example, the thumbturn assembly 200 may be utilized in combination with a standalone deadbolt mechanism, and/or the knob assembly 300 may be utilized in combination with a cylindrical lockset, a tubular lockset, or any other suitable lockset. In still other embodiments, the thumbturn assembly 200 and/or the knob assembly 300 may be utilized in combination with another form of fixture which need not necessarily include a lock. For example, the knob assembly 300 may be utilized as a manual actuator for a handleset, a rotary light switch, or a faucet. Furthermore, while the manual actuators are depicted herein as a thumbturn 220 and a knob 320, it is also contemplated that other forms of manual actuators such as, for example, paddles and/or levers are also contemplated.

FIGS. 5-9 depict knob assemblies according to further embodiments. In each of the illustrated knob assemblies, the knob and cutting mechanism are substantially similar to the knob 320 and cutting mechanism 330. Unless indicated otherwise, similar reference characters are used to indicate similar elements and features. In the interest of conciseness, the following descriptions focus primarily on features that are different than those described above with regard to the knob 320 and cutting mechanism 330.

Figure 5:
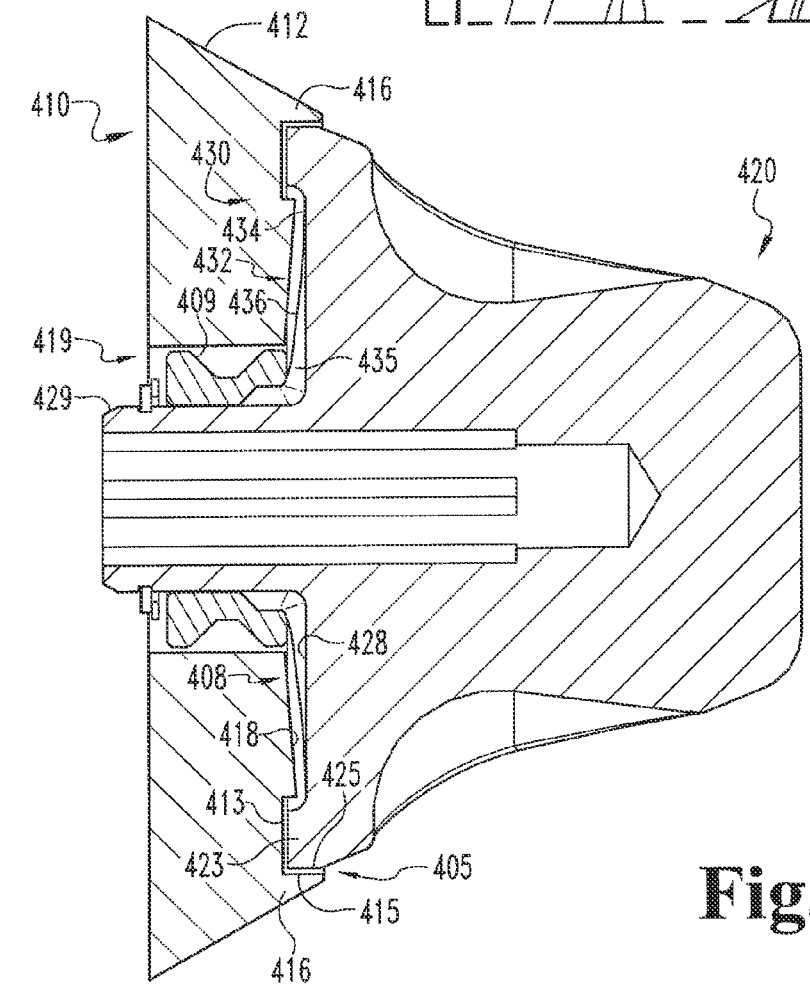
FIG. 5 is a cross-sectional view of a knob assembly according to another embodiment.
Figure 6A:
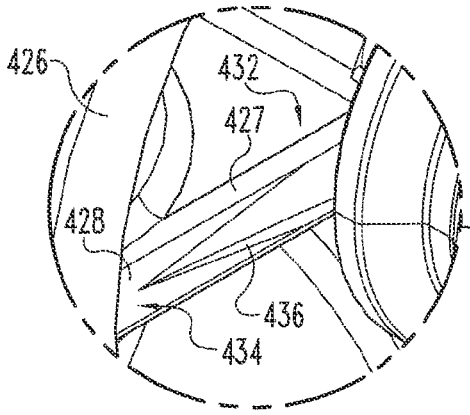
FIG. 6A is an enlarged perspective view of a portion of the knob illustrated in FIG. 6.
Figure 6:
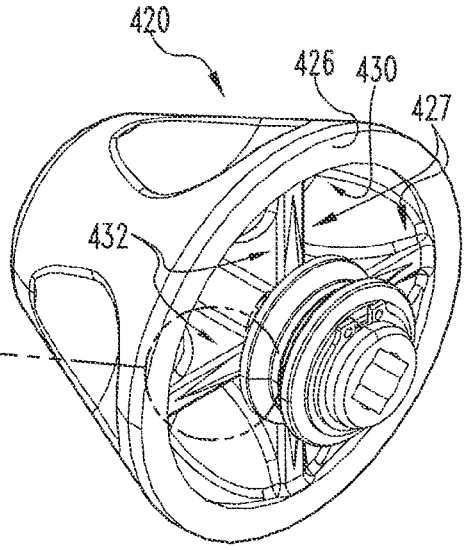
FIG. 6 is a perspective view of a knob assembly according to one embodiment.

With reference to FIGS. 5 and 6, a knob 420 includes a cutting mechanism 430 according to another embodiment. The cutting mechanism 430 includes a plurality of radially-extending cutting elements 432. Each of the cutting elements 432 is formed on a distal surface 428 of one of the support posts 427. In a manner similar to the above-described cutting elements 332, each of the illustrated cutting elements 432 includes a radially outer tip 434 and widens toward a radially inner base 435. Each cutting element 432 also includes a sharpened edge 436 which extends distally and radially inward from the tip 434 toward the base 435. In the illustrated form, the sharpened edge 436 extends along substantially the entire radial length of the cutting element 432. However, in other embodiments, the sharpened edge 436 need only extend along only a portion of the radial length of the cutting element 432.

When installed on a housing (i.e., housing 310), the cutting elements 432 are positioned in a gap formed between the distal surfaces 428 of the support posts 427 and the proximal surface 318 of the housing 310. If a ligature is inserted into the gap, the ligature will come into contact with one or more of the sharpened edges 436 which will in turn sever the ligature.

Figure 7A:
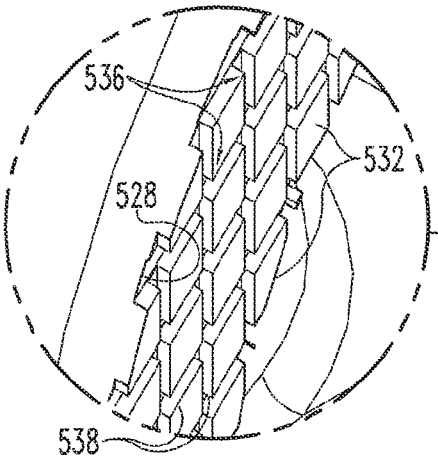
FIG. 7A is an enlarged perspective view of a portion of the knob illustrated in FIG. 7.
Figure 7:
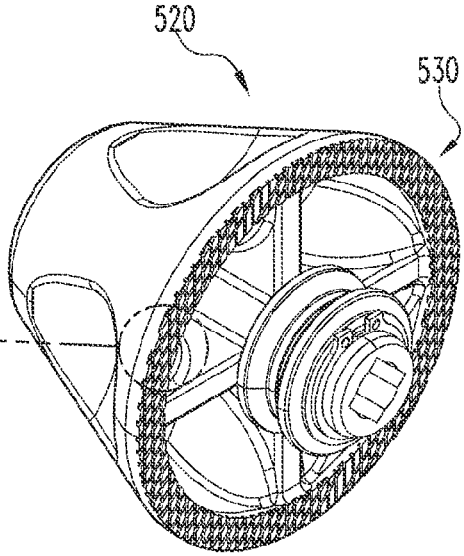
FIG. 7 is a perspective view of a knob assembly according to another embodiment.

With reference to FIG. 7, illustrated therein is a cutting mechanism 530 according to another embodiment which includes a plurality of diamond-shaped cutting elements 532. Each of the cutting elements 532 is substantially diamond-shaped and is formed on a distal surface 528 of the annular portion 526. Additionally, each of the illustrated cutting elements 532 includes a pair of sharpened edges 536, and channels 538 are formed between adjacent cutting elements 532. The cutting mechanism 530 of the illustrated embodiment may be a knurled cutting mechanism, and the cutting elements 532 may be formed by knurling of the annular portion 533. While the illustrated knurled cutting elements 532 are diamond-shaped, other forms and shapes of knurled cutting mechanisms are also contemplated. For example, a knurled cutting mechanism according to a further embodiment may include a plurality of pyramid-shaped cutting elements, each edge of which may be sharpened.

When installed on a housing (i.e., housing 310), the cutting elements 532 are positioned in a gap formed between the distal surface 528 of the annular portion 526 and the proximal surface 318 of the housing 310. If a ligature is positioned in the gap, the ligature may become caught in one or more of the channels 538, and the sharpened edges 536 will fray and/or sever the ligature.

Figure 8:
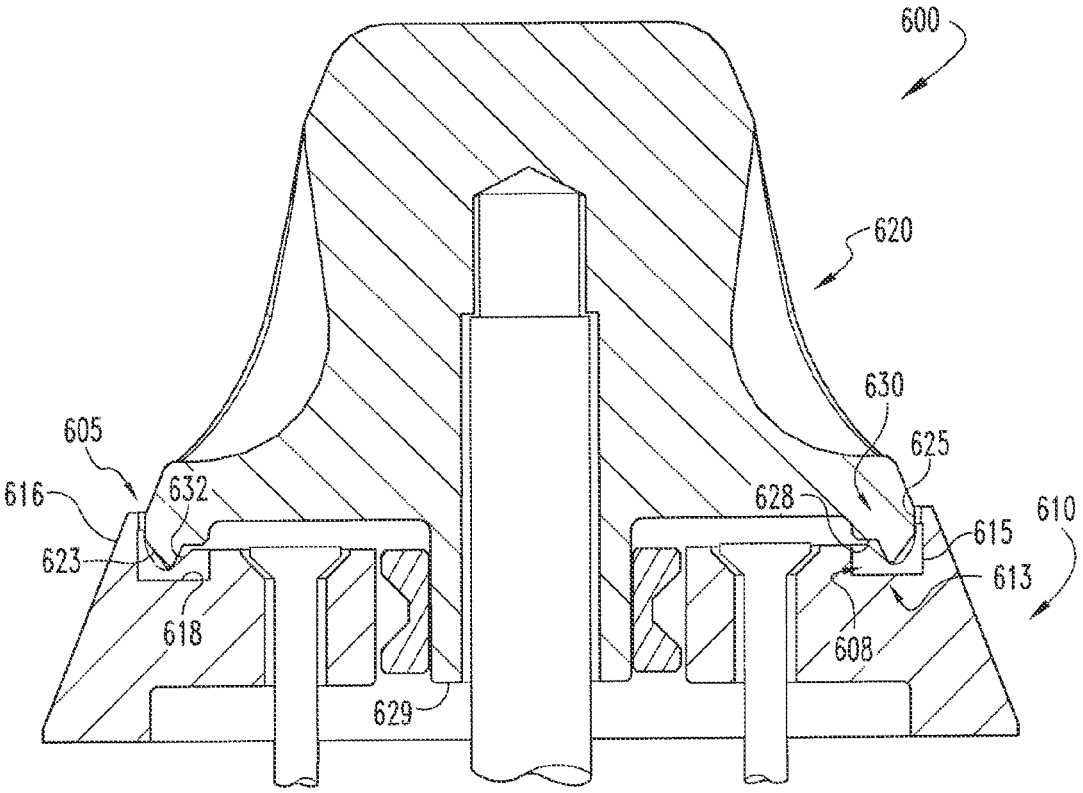
FIG. 8 is a cross-sectional view of a knob assembly according to another embodiment.
Figure 9:
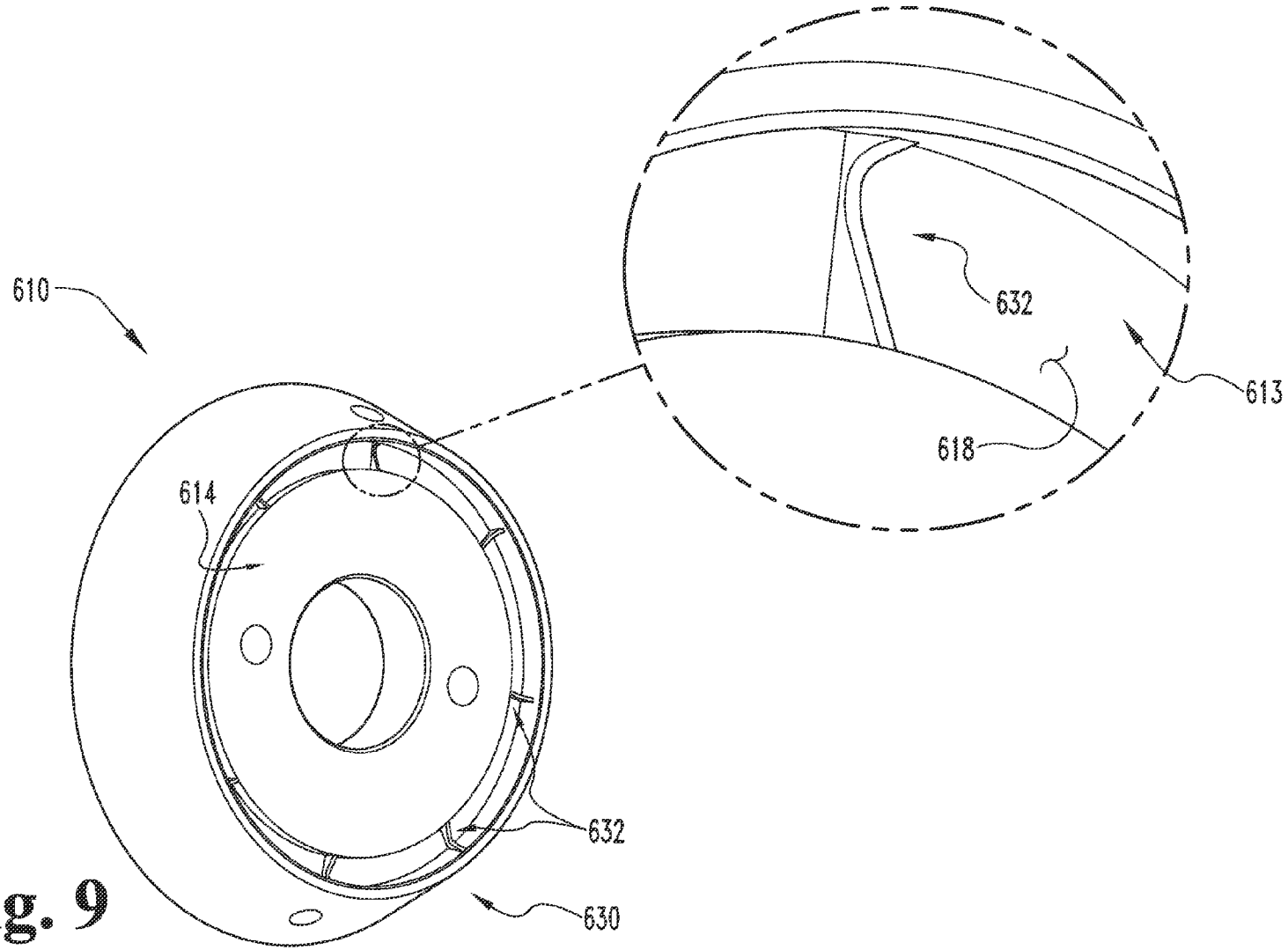
FIG. 9 is a perspective view of a portion of the knob assembly illustrated in FIG. 8.

With reference to FIGS. 8 and 9, illustrated therein is a knob assembly 600 according to another embodiment. The know assembly 600 generally includes a housing 610, a knob 620 rotatably mounted on the housing 610, and a cutting mechanism 630 positioned between the housing 610 and the knob 620. In contrast to the above-described knob assemblies, the cutting mechanism 630 of the illustrated embodiment is formed on the housing 610. More specifically, the cutting mechanism 630 includes a plurality of cutting elements 632 formed in the annular channel 613 of the housing 610. Thus, when the knob 620 is mounted to the housing 610, the cutting mechanism 630 is disposed in a gap 608 formed between a proximal surface 618 of the housing 610 and a distal surface 628 of the knob 620.

If a ligature is passed into the seam 605, the annular portion 626 of the knob 620 urges the ligature toward one or more of the cutting elements 632. The annular portion 626 may extend distally into the channel 613 and beyond a proximal end of the cutting elements 632 such that the ligature must pass over the cutting elements 632 in order to continue toward the stem 629. In some embodiments, the annular portion 626 may have a cross-section corresponding to that of the cutting elements 632 such that the annular portion 626 maintains the ligature in contact with the cutting elements 632.

Figure 10:
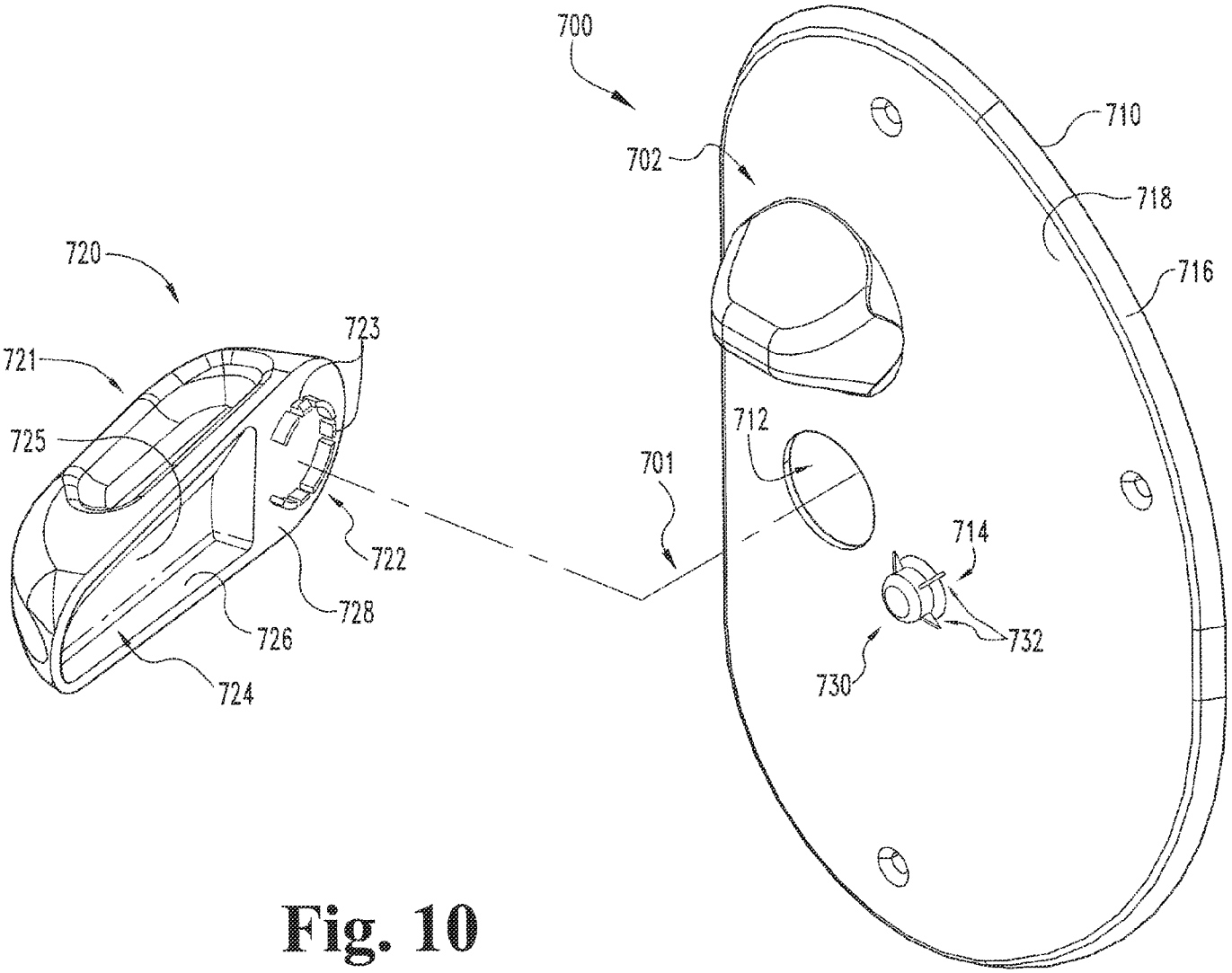
FIG. 10 is an exploded assembly view of an actuator assembly according to another embodiment.

With reference to FIG. 10, a handle assembly 700 according to another embodiment generally includes a housing in the form of a base plate 710, a manual actuator in the form of a lever 720 rotatably mounted on the base plate 710, and a cutting mechanism 730 positioned between the lever 720 and the base plate 710. The handle assembly 700 is configured for use with a lockset which may be in the form of the mortise assembly 110. For example, the base plate 710 may be mounted on the door 90, and the lever 720 may be operably coupled with the latchbolt mechanism 130. The handle assembly 700 may further include a thumbturn 702 such as, for example, to operate the deadbolt mechanism 120.

The base plate 710 generally includes an opening 712 configured to receive a portion of the lever 720, and may further include a hub 714 extending proximally from a proximal surface 718 of the base plate 710. The base plate 710 includes a circumferential surface 716 which may be tapered to inhibit use of the base plate 710 as an anchor for a ligature.

The lever 720 generally includes a manually graspable portion 721, a coupling device 722, and a pocket 724 defined in part by an inner surface 725 on the distal side of the lever 720 and a pair of sidewalls 726. While other forms are contemplated, the illustrated coupling device 720 includes a plurality of arcuate ridges 723 extending from a distal surface 728 of the lever 720. The coupling device 722 defines a portion of a circle and is sized and configured for receipt within an opening 712 formed in the base plate 710. At least some of the ridges 723 include snap features which engage the base plate 710 and prevent axial movement of the handle 720.

With the coupling device 722 received in the opening 712 and engaged with the base plate 710, the handle 720 is coupled to the base plate 710 and is pivotable about an axis 701. Additionally, a narrow seam or gap is formed between the distal surface 728 of the handle 720 and a proximal surface 718 of the base plate. Furthermore, the hub 714 is received in the pocket 724 and limits the pivotal range of the lever 720 by engaging the sidewalls 726 when the lever is pivoted to either of two pivotal extremes.

The cutting mechanism 730 includes a plurality of cutting elements 732 which are formed around or on the hub 714. The cutting mechanism 730 may be arranged such that the cutting elements 732 do not come into contact with the sidewalls 726. In the illustrated form, the cutting elements 732 are configured in a similar manner as those illustrated in FIG. 6. However, in other embodiments, the cutting mechanism 730 may take another form such as, for example, a knurling. While the illustrated cutting elements 732 are positioned at the hub 714, the cutting mechanism 730 may additionally or alternatively include cutting elements 732 in other locations such as, for example, on the coupling device 722 and/or on the lever distal surface 728.

In the illustrated embodiment, the pivotal range of the lever 720 is limited by engagement between the hub 714 and the sidewalls 726. In other embodiments, the hub 714 may instead be formed on the lever 720, and the base plate 710 may include an arcuate track through which the hub travels as the lever 720 pivots. In such forms, cutting elements may be formed on the hub of the lever 720.

In the embodiments described hereinabove, the cutting mechanisms are integrally formed with at least one of a manual actuator and a housing on which the manual actuator is rotatably mounted. However, it is also contemplated that a cutting mechanism need not be integrally formed with a manual actuator or a housing, and may instead constitute a discrete element mounted on one of the manual actuator and the housing. Furthermore, while each of the illustrated cutting mechanisms may be formed on only one of the manual actuator and the housing, it is also contemplated that a cutting mechanism may include cutting elements on each of the manual actuator and the housing.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

a housing having a first surface;

a manual actuator having a second surface facing the first surface, wherein the manual actuator includes a spindle that defines a rotational axis extending in a proximal direction and an opposite distal direction, wherein the first surface is a proximal surface of the housing, wherein the second surface is a distal surface of the manual actuator, wherein the spindle extends distally beyond the second surface and into an opening formed in the housing, wherein the manual actuator is rotatably mounted on the housing, and wherein the second surface is offset from the first surface in the proximal direction such that a gap is formed between the first surface and the second surface; and a cutting mechanism positioned in the gap, the cutting mechanism including at least one sharpened edge configured to cut a ligature positioned in the gap.

2. The system of claim 1, wherein the housing further comprises an arcuate ridge having a radially inner surface;

wherein the manual actuator has a radially outer surface facing the radially inner surface of the ridge;

wherein a seam is formed between the radially inner surface of the ridge and the radially outer surface of the manual actuator; and wherein the seam is in communication with the gap.

3. The system of claim 2, wherein the radially outer surface of the manual actuator is circular shaped, and the arcuate ridge circumferentially surrounds the radially outer surface of the manual actuator.

4. The system of claim 3, wherein the housing defines a circular recess, and wherein the manual actuator further comprises an annular protrusion seated in the circular recess.

5. The system of claim 4, wherein the circular recess includes an annular channel defining the proximal surface of the housing, the annular protrusion defines the distal surface of the manual actuator, and the gap defines an annular gap.

6. The system of claim 5, wherein the at least one sharpened edge includes a plurality of sharpened edges, wherein the cutting mechanism comprises a plurality of cutting elements angularly spaced from one another within the annular gap, and each of the cutting elements includes a corresponding one of the plurality of sharpened edges.

7. The system of claim 6, wherein the cutting mechanism is coupled to the annular protrusion, wherein each of the cutting elements has a radially outer tip; and wherein the sharpened edge of each of the cutting elements extends distally from the tip toward the proximal surface of the housing.

8. The system of claim 7, wherein each of the cutting elements further comprises a radially inner base, and wherein the sharpened edge of each of the cutting elements extends radially inward from the tip toward the base.

9. The system of claim 6, wherein the cutting mechanism is coupled to the housing, and each of the cutting elements is positioned in the annular gap.

10. The system of claim 9, wherein a distal portion of the annular protrusion tapers radially inward toward the sharpened edges.

11. The system of claim 2, wherein the manual actuator is a knob, the manual actuator further comprising a stem coupled to the spindle and extending along the rotational axis of the spindle, and a plurality of support posts extending radially outward from the stem;

wherein the cutting mechanism includes a plurality of cutting elements; and wherein each of the cutting elements is formed on respective ones of the support posts.

12. The system of claim 1, further comprising:

a thumbturn assembly including:

a thumbturn housing having a second proximal surface;

a thumbturn having a second distal surface facing the second proximal surface of the housing, wherein the thumbturn is rotatably mounted on the thumbturn housing, and a second gap is formed between the second proximal surface and the second distal surface; and a second cutting mechanism positioned in the second gap; and a mortise assembly configured for mounting in a mortise cutout of a door, the mortise assembly including:

a deadbolt mechanism including a deadbolt, wherein the deadbolt mechanism is operably connected to the thumbturn and is configured to move the deadbolt in response to rotation of the thumbturn; and a latchbolt mechanism including a latchbolt, wherein the latchbolt mechanism is operably connected to the manual actuator and is configured to move the latchbolt in response to rotation of the manual actuator.

13. The system of claim 1, wherein the cutting mechanism includes a plurality of knurled cutting elements.

14. The system of claim 1, wherein the cutting element is integrally formed with one of the housing and the manual actuator.

15. The system of claim 1, wherein each of the housing and the manual actuator is configured to inhibit the ligature from hanging thereon.

16. A system, comprising:

a mounting device configured for mounting on a surface of a door, the mounting device including an opening;

a manual actuator mounted on the mounting device, wherein the manual actuator is rotatable about a rotational axis and has a radially outer surface;

a bolt mechanism including a bolt having an extended position and a retracted position, wherein the bolt mechanism is engaged with the manual actuator through the opening, and the bolt mechanism is configured to move the bolt between the extended and retracted positions in response to rotation of the manual actuator; wherein the mounting device has a proximal surface, wherein the manual actuator further has a distal surface facing the proximal surface of the mounting device; and a cutting mechanism positioned between the radially outer surface and the rotational axis, wherein the manual actuator axially covers the cutting mechanism; further wherein the cutting mechanism is positioned between the proximal surface of the mounting device and the distal surface of the manual actuator, the cutting mechanism including at least one sharpened edge configured to cut a ligature positioned between the proximal surface of the mounting device and the distal surface of the manual actuator.

17. The system of claim 16, wherein the manual actuator comprises a thumbturn including a manually graspable portion and a disc portion, and the distal surface of the manual actuator is formed on a distal side of the disc portion.

18. The system of claim 17, wherein the mounting device includes an arcuate channel defining the proximal surface of the mounting device, and wherein the cutting mechanism includes at least one cutting element extending distally into the arcuate channel from the distal surface of the manual actuator, wherein the at least one cutting element correspondingly includes the at least one sharpened edge.

19. The system of claim 16, wherein the mounting device includes an arcuate channel, and the cutting mechanism includes at least one cutting element positioned at least partially in the arcuate channel, wherein the at least one cutting element correspondingly includes the at least one sharpened edge.

20. The system of claim 19, wherein the arcuate channel is an annular channel centered on the rotational axis, wherein the at least one sharpened edge includes a plurality of sharpened edges, the at least one cutting element includes a plurality of cutting elements including the plurality of sharpened edges, respectively, and wherein the plurality of cutting elements are angularly spaced from one another about the annular channel.

21. A system, comprising:

a housing comprising:

a circular recess, wherein the circular recess includes an annular channel defining a proximal surface of the housing; and an arcuate ridge having a radially inner surface;

a manual actuator rotatably mounted on the housing, the manual actuator comprising:

an annular protrusion seated in the circular recess, wherein the annular protrusion defines a distal surface of the manual actuator, wherein the distal surface of the manual actuator faces the proximal surface of the housing such that an annular gap is formed therebetween; and a radially outer surface facing the radially inner surface of the ridge, wherein the radially outer surface is circular shaped, wherein the arcuate ridge circumferentially surrounds the radially outer surface, wherein a seam is formed between the radially inner surface of the ridge and the radially outer surface of the manual actuator, and wherein the seam is in communication with the gap; and a cutting mechanism positioned in the gap, wherein the cutting mechanism is coupled to the annular protrusion, the cutting mechanism comprising:

a plurality of sharpened edges, wherein each sharpened edge is configured to cut a ligature positioned in the gap; and a plurality of cutting elements angularly spaced from one another within the annular gap, wherein each of the cutting elements includes a corresponding one of the plurality of sharpened edges;

wherein each of the cutting elements has a radially outer tip; and wherein the sharpened edge of each of the cutting elements extends distally from the tip toward the proximal surface of the housing.

22. A system, comprising:

a housing having a proximal side and a distal side, wherein the proximal side of the housing comprises a circular recess and a circular ridge, wherein the circular recess is defined at least in part by a radially inner surface of the circular ridge and a proximal-facing surface; and a manual actuator rotatably mounted on the housing, the manual actuator having a proximal end portion and a distal end portion, wherein the distal end portion includes a radially outer surface having a circular shape, wherein the radially outer surface faces and is circumferentially surrounded by the radially inner surface of the ridge such that a seam is formed therebetween, and wherein the distal end portion includes a distal-facing surface facing the proximal-facing surface of the housing such that a gap is formed therebetween, and wherein the gap is in communication with the seam; and a cutting mechanism positioned in the gap, wherein the cutting mechanism comprises a plurality of cutting elements angularly spaced from one another about a rotational axis of the manual actuator, wherein each cutting element is coupled to one of the proximal-facing surface and the distal-facing surface and includes a sharpened edge extending toward the other of the proximal-facing surface and the distal-facing surface, and wherein the sharpened edge of each cutting element is configured to cut a ligature positioned in the gap.

23. The system of claim 22, wherein the circular recess further comprises an annular channel, wherein the distal end portion further comprises an annular protrusion extending into the annular channel, wherein the annular channel includes the proximal-facing surface, and wherein the annular protrusion includes the distal-facing surface.

24. The system of claim 22, wherein the housing further comprises an opening, wherein the manual actuator further comprises a spindle, wherein the spindle extends distally beyond the distal-facing surface and into the opening, and wherein the manual actuator is rotatable about the rotational axis, wherein the rotational axis is defined by the spindle.

* * * * *